US007211554B1

(12) United States Patent
Arrechavaleta

(10) Patent No.: US 7,211,554 B1
(45) Date of Patent: May 1, 2007

(54) AQUEOUS TILE AND GROUT CLEANER AND METHOD OF USE

(76) Inventor: Eduardo Arrechavaleta, 4451 NW. 196th St., Opa Locka, FL (US) 33055

( * ) Notice: Subject to any disclaimer, the term of this patent is extended or adjusted under 35 U.S.C. 154(b) by 0 days.

(21) Appl. No.: 11/146,245

(22) Filed: Jun. 7, 2005

(51) Int. Cl.
*C11D 3/20* (2006.01)

(52) U.S. Cl. ..... 510/238; 510/240

(58) Field of Classification Search ..... 510/238, 510/240

See application file for complete search history.

(56) References Cited

U.S. PATENT DOCUMENTS 3,481,879 A * 12/1969 Salomone ..... 510/240
3,647,479 A * 3/1972 Beereboom et al. ..... 426/536
4,028,261 A 6/1977 Petersen et al.
4,200,662 A * 4/1980 Scibelli ..... 426/583
4,613,378 A * 9/1986 Christy ..... 134/2
4,749,508 A 6/1988 Cockrell, Jr. et al.
5,316,692 A * 5/1994 John ..... 510/397
5,342,535 A * 8/1994 Ramirez et al. ..... 424/57
5,885,951 A 3/1999 Loder
6,767,881 B1 * 7/2004 Griese et al. ..... 510/421
2004/0122112 A1 * 6/2004 Griese et al. ..... 516/43

* cited by examiner

*Primary Examiner*—Charles Boyer
(74) *Attorney, Agent, or Firm*—Crossley Patent Law; Mark A. Crossley

(57) ABSTRACT

A aqueous composition and method of use for cleaning tile and grout and the like, the composition is particularly suited to cleaning newly laid tile and the films that typically cover it. The composition is a basic solution of glucose and distilled water with optionally included colorant and fragrance. The composition contains no harsh acids or caustics. The composition is fully biodegradable. Because of the composition's basic and biodegradable advantages, the method of use is basic and uncomplicated, requiring no concerns in disposal.

1 Claim, 1 Drawing Sheet

AQUEOUS TILE AND GROUT CLEANER AND METHOD OF USE

FIELD OF THE INVENTION

This invention relates to chemical composition of cleaners and more specifically to an aqueous glucose composition for cleaning tile and grout tile and grout cleaner and a method of use of same.

BACKGROUND OF THE INVENTION

Tile cleanup, especially tile cleanup in new construction, offers a challenge to many complex chemical cleaning agents. The grout film remaining on tile after initial installation, and the dust typical of construction environments, are a problem in cleaning. Quick and basic cleanup is atypical. Most workers have been forced to use agents that are not desirable with respect to the immediate environment, our overall environment, and the new tile and grout. However, the tile must be cleaned of the above-mentioned films.

Cleaners typically used present their own set of problems, none of which are desirable, but problems which include: remaining residue, environmentally undesirable effects, reactions with grout and especially new grout, added effort in application and removal of the cleaners themselves. The aqueous tile and grout cleaner, though, negates all of these concerns and others that arise. Other typical concerns include but are not limited to the chemical attack of caustic and acidic cleaners on surrounding trims and materials proximal to the tile, as well as the needs for complete rinsing of the chemical agents. Further concerns are the disposal of chemicals used and rinsed from floors.

DESCRIPTION OF THE PRIOR ART

Prior art teaches various cleaning solutions of complex chemical makeup, most with either caustic or acidic properties. None offer the basic, biodegradable, environmentally friendly makeup of the present invention. By way of example:

U.S. Pat. No. 4,028,261 issued to Peterson, et al. on Jun. 7, 1977 discloses a tile and grout cleaner and restorer that is typical of others taught in the prior art in that the disclosure is of a complex chemical makeup. As such, it differs significantly from the present invention.

U.S. Pat. No. 5,885,951 issued to Loder on Mar. 23, 1999 discloses another complex chemical agent for cleaning tile, tub and grout. Again, like the above disclosure, it differs dramatically from the present invention.

While the above-described devices fulfill their respective and particular objects and requirements, they do not describe an aqueous tile and grout cleaner that provides for the advantages of the present invention, therefore, a need exists for an improved aqueous tile and grout cleaner, particularly one that includes no harsh acidic or caustic properties, nor any non-biodegradable ingredients. Additionally, an aqueous tile and grout cleaner for use in cleanup in new construction or tile installation is further needed. In this respect, the present invention substantially departs from the conventional concepts and designs of the prior art.

SUMMARY OF THE INVENTION

In view of the foregoing disadvantages inherent in the known types of tile and grout cleaners now present in the prior art, the aqueous tile and grout cleaner overcomes the above-mentioned disadvantages and drawbacks of the prior art.

As such, the general purpose of the aqueous glucose composition for cleaning tile and grout, described subsequently in greater detail, is to provide a aqueous tile and grout cleaner which has all of the advantages of the prior art mentioned heretofore and many novel features that result in an improved aqueous tile and grout cleaner which is not anticipated, rendered obvious, suggested, or even implied by the prior art, either alone or in combination thereof.

To accomplish this, the aqueous tile and grout cleaner is comprised of the basic ingredients distilled water, granulated sugar, colorant, and fragrance. While these ingredients make up the preferred example of the cleaner, fragrance and colorant are not mandatory to the effectiveness of the chemical composition. The weight/weight ratio is about 10% to 21% of glucose to water. Preferably the ratio is about 15% glucose to water. The composition therefore comprises about 425 to about 990 grams of glucose dissolved in about 3,840 milliliters of distilled water. Optionally, about 240 milliliters of fragrance is added. Optionally, 120 milliliters of color dye #5 is added. Color dye #5 is known in the art as CL-191400. Glucose used is from various forms of glucose, including but not limited to granulated sugar and powdered sugar. The chemical formula for glucose is $C_6H_{12}O_6$. Distilled water is $H_2O$. Fragrance and dye are varied in different examples. Fragrances from a variety of scents such as pine, spruce, lemon, and the like are utilized. Fragrances are not limited to this list. Fragrance #16, used in one example of the invention, is known in the art. Dye, also termed colorant, is added in order to more accurately observe application and application quantities. Color dye #5 is known in the industrial arts.

The ratio of glucose to water as defined comprises the preferred example. Other ratios are utilized in varied examples.

The aqueous tile and grout cleaner offers easy application, easy rinse, and negates concerns of environmental complications. Precautions concerning surrounding materials are no longer needed. The cleaner is mopped or wiped on, then rinsed off by any convenient means. Rubbing the cleaner across the tiles and agitating the cleaner into the grout aid effectiveness. Tools used in rubbing and agitating include but are not limited to mops, sponges, rags, and the like. Fragrance is added to affect feedback of cleanliness. Colorant aids in recognizing dispersion of the cleaner. While distilled water is not imperative, its use insures that no contaminants are added to the mix, contaminants that might, possibly, precipitate out or leave any sort of film.

Thus has been broadly outlined the more important features of the aqueous tile and grout cleaner so that the detailed description thereof that follows may be better understood and in order that the present contribution to the art may be better appreciated.

Numerous objects, features and advantages of the aqueous tile and grout cleaner will be readily apparent to those of ordinary skill in the art upon reading the following detailed description of presently preferred, but nonetheless illustrative, examples of the aqueous tile and grout cleaner when taken in conjunction with the accompanying drawings.

In this respect, before explaining the current examples of the aqueous tile and grout cleaner in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the aqueous tile and grout cleaner. It is therefore important that the claims be regarded as including such equivalent constructions insofar as they do not depart from the spirit and scope of the present invention.

Objects of the aqueous tile and grout cleaner, along with various novel features that characterize the invention are particularly pointed out in the claims forming a part of this disclosure. For better understanding of the aqueous tile and grout cleaner, its operating advantages and specific objects attained by its uses, refer to the accompanying drawings and description.

DETAILED DESCRIPTION OF THE PREFERRED EXAMPLE

Figure 1:
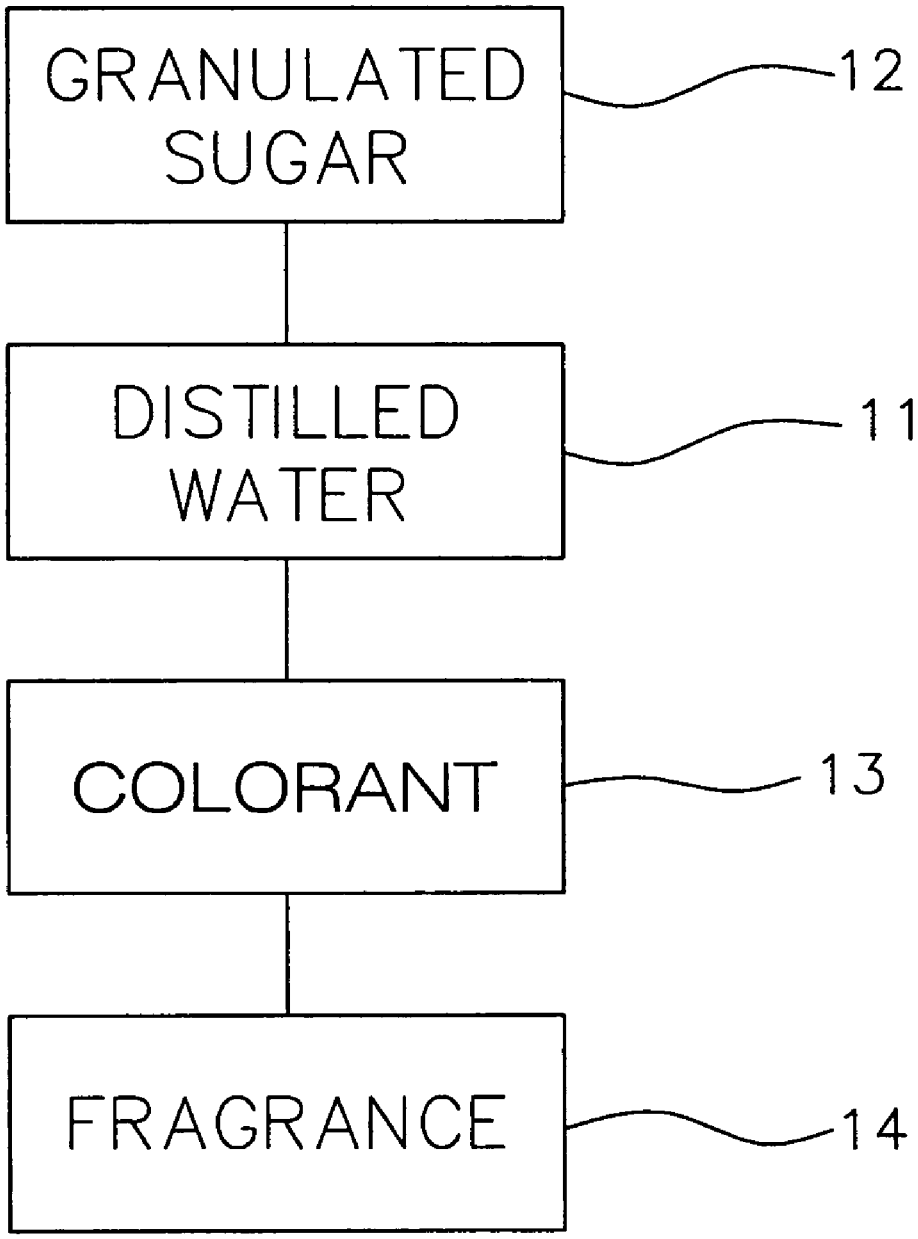
FIG. 1 depicts the chemical components of the aqueous tile and grout cleaner, with optional colorant and fragrance included.

With reference now to the drawing, FIG. 1, the preferred example of the aqueous tile and grout cleaner employing the principles and concepts of the present invention and generally designated by the reference number 10 will be described.

Referring to FIG. 1, invention 10 comprises granulated sugar 12, chemical formula $C_6H_{12}O_6$, distilled water ($H_2O$), Colorant Dye #5 (CL-19140), a dye known in the industry and Fragrance #16, a fragrance known in the industry.

In preparation, distilled water 11 is warmed but does not exceed the boiling point of water (212 degrees Fahrenheit at sea level). Sugar 12 in the form of glucose is added to the water 11 to form the aqueous solution. The weight/weight ratio is about 10% to 21% glucose to water. The preferred ratio is about 15% glucose to water. Colorant Dye #13 and Fragrance #16 are optionally added to the mixture. The preferred ratio of Fragrance #16 to water is about 240 ml of Fragrance #16 to 3,840 ml of the glucose and water solution. The preferred ratio of Colorant Dye #5 to water is about 120 ml of Colorant Dye #5 to 3,840 ml of glucose water solution. The invention 10 is complete with solution of the ingredients. The invention 10 mixture is cooled.

In use, chemical composition 10 is spread on tile and grout (not shown). Tile, especially when newly installed, typically has a film (not shown) of grout. The film is typically deposited from the application of grout in properly setting the tile. The invention 10 is spread with any preferred applicator (not shown).

Applicators typically used include mops, sponges, and rags. Mildly rubbing the invention 10 across the tile aids effectiveness. Agitating the invention 10 into the grout with the above listed tools aids effectiveness. The invention 10 is then typically rinsed off with available tap water. Invention 10 is stored in a sealed container (not shown) to avoid evaporation. Mixture 10 is used at any time above freezing temperatures.

With respect to the above description then, it is to be realized that the optimum dimensional relationships for the parts of the aqueous tile and grout cleaner, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of using a tile and grout cleaner, the cleaner consisting of:

a) 637 grams of glucose;

b) about 3,840 milliliters of warmed water, the water warmed to less than 212 degrees Fahrenheit;

c) about 240 milliliters of a liquid Fragrance #16;

d) about 120 milliliters of a Colorant Dye #5 (CL-19140);

the method consisting of the steps of:

spreading the composition on the tile and grout until uniform color dispersion is recognized;

rubbing the composition into the tile and grout;

rinsing the composition from the tile and grout until no visual or olfactory residue of the cleaner remains.

* * * * *